United States Patent [19]

Sittner

[11] Patent Number: 4,463,827

[45] Date of Patent: Aug. 7, 1984

[54] ADJUSTABLE HANDHOLD

[75] Inventor: Edward H. Sittner, St. Charles, Mo.

[73] Assignee: ACF Industries, Incorporated, New York, N.Y.

[21] Appl. No.: 403,989

[22] Filed: Aug. 2, 1982

[51] Int. Cl.[3] ..... E06C 9/04

[52] U.S. Cl. ..... 182/93; 182/90; 182/194; 182/228

[58] Field of Search ..... 182/93, 99, 228, 194

[56] References Cited

U.S. PATENT DOCUMENTS

| | | | |
|---|---|---|---|
| 806,922 | 12/1905 | Saling et al. | 182/99 |
| 988,719 | 4/1911 | Keyes et al. | 182/93 |
| 1,093,020 | 4/1914 | Williams | 182/99 |
| 1,118,404 | 11/1914 | Dunderdale | 182/93 |
| 1,157,602 | 10/1915 | Trimyer | 182/99 |
| 2,395,612 | 2/1946 | Cremean | 29/414 |

*Primary Examiner*—R. P. Machado

*Attorney, Agent, or Firm*—Henry W. Cummings

[57] ABSTRACT

In accordance with the present invention a handhold (10) is provided including a base handhold member (12) including a first fastening flange portion (16) and a longitudinally extending rod portion (14). The length of the longitudinal portion is sufficient to meet most if not all distances between fasteners utilized on railway cars and other transportation vehicles. A second handhold member (30) includes a base portion (32) having an opening 34 and an upwardly extending flange portion (40). The base portion slidingly receives the rod portion and thus enables adjustment of the distance between the flange portions. The rod portion thus may be cut at the installation site to meet desired length. In one embodiment the distance $D_2$ of the second flange above or below the rod may be varied by utilizing a selected member having this desired distance. Also different second members may have selected distances $D_1$ from the vehicle body. The second member is held in place by mechanically deforming the cut end of the rod portion to prevent exit of the second member.

15 Claims, 11 Drawing Figures

42'''
30'''
40'''
36'''
14'''
32'''

30
44
24

22
20
16
18
14
12

30
40
10
D2
24
42
40
36
32
38
14
34
D1

42'
40'
30'
36'
32'
20'
14'
15'
12'
24'

42''
40''
30''
36''
32''
38''
22''
20''
14''
12''
24''

44'''

22'''
30'''
14'''
32'''
20'''
12'''
34'''
38'''
24''' l1
36'''
l
30'''
l2

ADJUSTABLE HANDHOLD

BACKGROUND OF THE INVENTION

In the past, grab irons and handholds have normally been made of one piece of material and formed into desired shape. See U.S. Pat. No. 2,395,612 (1946).

However, with a one piece device, car builders and repair facilities must stock many different size handholds. This requires a great deal of space and expense to maintain such an inventory.

SUMMARY OF THE INVENTION

The object of the invention is to provide a two piece handhold which provides a variable distance between longitudinal fastening points.

Another object is to enable the distance from the rod to a point above or below the rod to be varied.

Another object is to provide the ability to vary the distance from the rod inwardly to the vehicle body.

In accordance with the present invention a handhold is provided including a base handhold member including a first fastening flange portion and a longitudinally extending rod portion. The length of the longitudinal portion is sufficient to meet most if not all distances between fasteners utilized on railway cars and other transportation vehicles. A second handhold member includes a base portion having an opening and an upwardly extending flange portion. The base portion slidingly receives the rod portion and thus enables adjustment of the distance between the flange portions. The rod portion thus may be cut at the installation site to meet desired length.

In one embodiment the distance of the second flange above or below the rod may be varied by utilizing a selected second member having this desired distance. Also different second members may have selected distances from the vehicle body. The second member is held in place by mechanically deforming the cut end of the rod portion to prevent exit of the second member.

IN THE DRAWINGS

DESCRIPTION OF PREFERRED EMBODIMENTS

Figures 1, 2, 3, 4, 5, 6, 7, 8, 9, 10, 11:
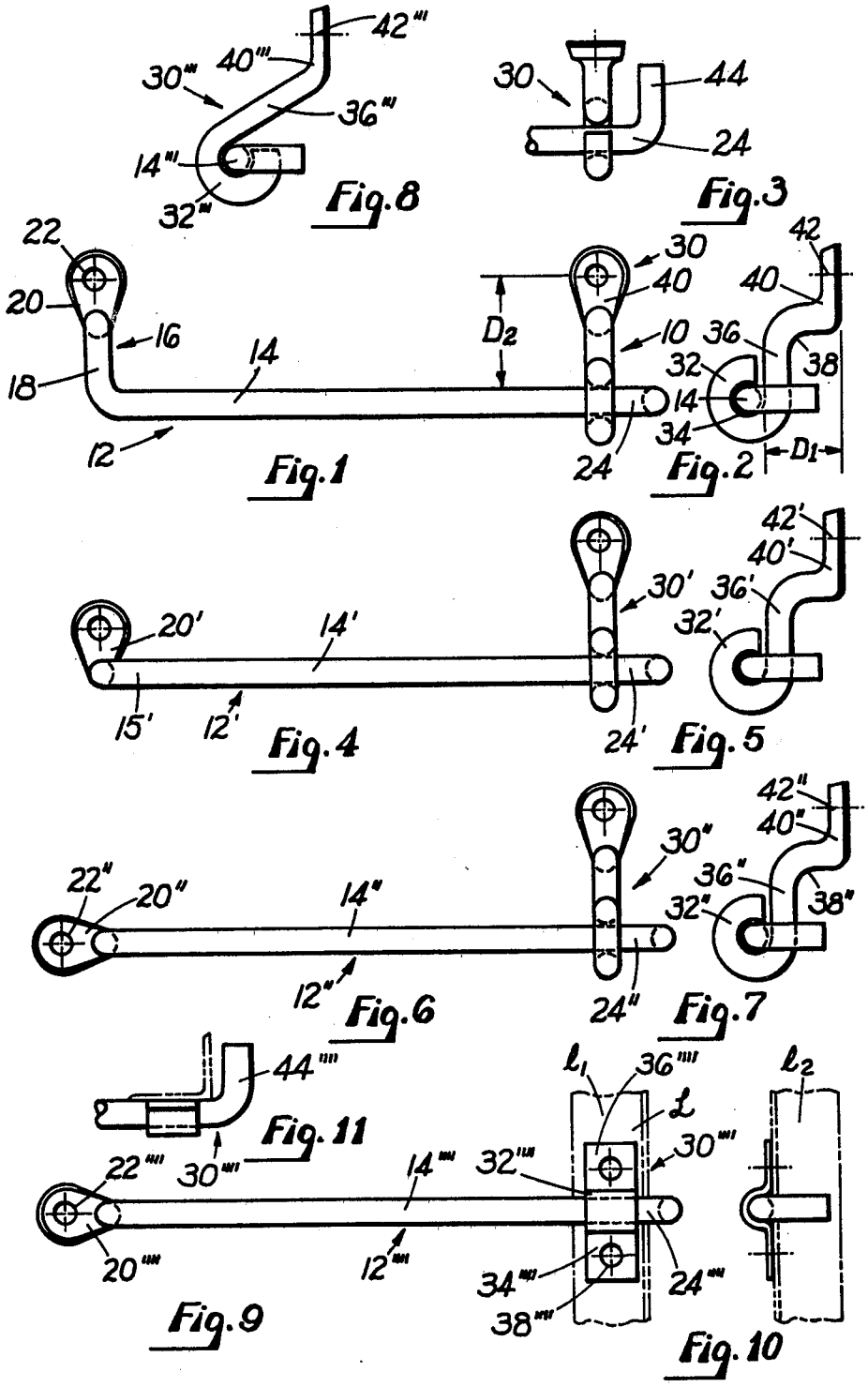
FIG. 1 is a side elevation view of one embodiment of the present invention.
FIG. 2 is an end elevation view of FIG. 1.
FIG. 3 is a plan view of a portion of FIG. 1.
FIG. 4 is a side elevation view of another embodiment of the present invention.
FIG. 5 is an end elevation view of FIG. 4.
FIG. 6 is a side elevation view of another embodiment of the present invention.
FIG. 7 is an end elevation view of FIG. 6.
FIG. 8 is an end elevation view of another embodiment of the second member to be used in the present invention.
FIG. 9 is a side elevation view of another embodiment of the present invention.
FIG. 10 is an end elevation view of FIG. 9.
FIG. 11 is a plan view of a portion of FIG. 10.

A handhold assembly of the present invention is illustrated in the drawings generally at 10. This assembly comprises a first member 12 including a longitudinally extending rod portion 14 and a flange portion indicated generally at 16. In one embodiment the rod portion 14 is bent at 18, and then a flat portion 20 is formed integral therewith including an opening 22 to receive a fastener to hold this end in place upon a railway car or other transportation vehicle. The length of the rod portion 14 from the flange portion 16 is sufficient to accomodate most, if not all, of the sizes encountered on railway cars and other transportation vehicles. The end of the end 24 of the rod is left in the unformed condition.

A second member indicated generally at 30 comprises a base portion 32 containing an opening 34 to receive the rod portion 14. The shape of the curved portion 34 is such as to be complimentary to the rod portion 14. For example, if a circular cross section is utilized, clearance of approximately 1/16" is conveniently utilized. It is to be born in mind, however, that the present invention is not limited to a circular cross section and other convenient cross sections such as square or hexagon may be utilized.

A body portion 36 extends upwardly from the base portion and normally includes a curvature 38. Extending upwardly then from the base portion is a flat flange portion 40 which is conveniently flush with the flat portion 20 in terms of its distance inwardly from the rod 14. This distance being indicated by D1 in FIG. 2. The flange portion includes an opening 42 to attach the end hold assembly to a railway car or other transportation vehicle. In order to hold the second member 30 in place, the end 24 of the rod portion is mechanically deformed, preferably by hot forming, to prevent escape of the second member 30 from the first member 12. Thus as shown in FIG. 3, the end portion 24 is bent 90° as indicated at 44 to hold the second member in place.

A plurality of second members 30 would normally be utilized. The members 30 would have variable distances D1 from the rod portion inwardly to the wall of the transportation vehicle, and variable distances D2 (FIG. 1) of the flange portion 40 above the rod portion. Since these are small items, they are easily stored without occupying a great deal of storage space.

It is also within the scope of the present invention to utilize a variety of different first members. For example, as shown in FIG. 4 the first member 12' includes a flange portion 20' which is formed at the end 15' of the first member and no bend is utilized. In this instance the second member 30' is constructed in the same manner as the member 30 in FIGS. 1–3.

In another alternative as illustrated in FIG. 5, the flange portion 20'' is located along the same axis as the rod portion 14''. Thus the opening 22'' is also along the axis of the rod 14''. Again in this embodiment the second member 30'' is constructed in the same manner as in FIGS. 1–3.

In still another alternative shown in FIG. 8, the second member 30''' includes a base portion 32''' which receives a rod portion 14''' and a body portion 36''' which is formed or bent at an incline instead of a right angle in the previous embodiments. The mounting flange portion 40''' includes a fastener opening 42'''. For some applicators it may be easier to form the inclined body portion 36'''.

Preferably for hot forming of the end portions 24, 24' and 24'' hot forming takes place at 1550° to 1700° F. This can be conveniently done with a torch and a bar or other suitable tool to bend the rod 90° or some other number of degrees which will insure that the second member does not escape.

In another embodiment of this present invention (FIG. 9) first member 12'''' includes a fastening portion 20'''' having an opening 22''''. An existing ladder L is illustrated in part. A second member 30'''' includes a body portion 32'''' and flange portions 34'''' and 36'''' into which fasteners 38'''' are inserted to hold the first member in engagement with the ladder. As in previous embodiments the end portion 24'''' is bent 90° as illustrated in FIG. 11. Ladder "L" includes legs L1 and L2 illustrated respectively in FIGS. 9 and 10. It is apparent that the distance between the fastening opening 22'''' and the ladder "L" can vary as desired. The end portion 44'''' is then bent and the fasteners 38'''' inserted to hold the member 12'''' in engagement with the ladder "L".

What is claimed is:

1. An adjustable handhold assembly comprising: a base handhold member including a first flange mounting portion and a longitudinally extending portion; said first flange portion spaced laterally from said longitudinally extending portion; the length of said longitudinal rod portion being sufficient to meet most distances between fasteners utilized on transportation vehicles; a second handhold member including a base portion having an opening and an outwardly extending second flange mounting portion aligned with said first flange portion; said opening slidingly receiving said rod portion and thereby enabling adjustment of the distance between the flange portions; whereby said rod portion may be cut to the desired length at the installation site; said rod portion being bent at its end portion adjacent said second flange portion.

2. An adjustable handhold assembly according to claim 1, wherein the distance of the second mounting flange above or below the rod may be varied by utilizing a selected second member having the desired distance.

3. An adjustable handhold assembly according to claim 1, wherein different second members may have selected distances from the vehicle body.

4. An adjustable handhold assembly according to claim 1, wherein said second member is held in place by mechanically deforming the end of said rod portion to prevent exit of the second member.

5. An adjustable handhold assembly according to claim 1, wherein said rod portion is bent on a first end and said first mounting flange portion is connected to the bent portion.

6. An adjustable handhold assembly according to claim 1, wherein said mounting flange portion is connected to a first end of said rod portion and said rod portion at its first end is substantially straight.

7. An adjustable handhold assembly according to claim 6, wherein said mounting flange portion extends perpendicular to said rod portion.

8. An adjustable handhold assembly according to claim 7, wherein said first mounting flange portion extends along the axis of said rod portion.

9. An adjustable handhold assembly according to claim 4, wherein said rod portion is mechanically deformed at least 90° to hold said second handhold member in place.

10. An adjustable handhold assembly according to claim 2, wherein a plurality of different second handhold members having a different distance from the rod portion to the second mounting flange portion are provided.

11. An adjustable handhold assembly according to claim 3, wherein a plurality of different second handhold members are provided having different distances from the rod portion to the second mounting flange portion.

12. An adjustable handhold assembly according to claim 1, wherein said second member includes a body portion which is inclined between the base portion and said second flange mounting portion.

13. An adjustable handhold assembly according to claim 1, wherein said second member is connected to a ladder.

14. An adjustable handhold assembly according to claim 1, wherein said second member includes upper and lower flange portions on either side of said rod.

15. An adjustable handhold assembly according to claim 14, wherein said flange portions abut one leg of a ladder.

* * * * *